US009175858B2

(12) United States Patent
Tisselli et al.

(10) Patent No.: US 9,175,858 B2
(45) Date of Patent: Nov. 3, 2015

(54) GAS COOKER

(75) Inventors: Filippo Tisselli, Forlimpopoli (IT); Francesco Corleoni, Meldola (IT)

(73) Assignee: ELECTROLUX HOME PRODUCTS CORPORATION N.V., Brussels (BE)

( * ) Notice: Subject to any disclaimer, the term of this patent is extended or adjusted under 35 U.S.C. 154(b) by 829 days.

(21) Appl. No.: 13/393,279

(22) PCT Filed: Sep. 17, 2010

(86) PCT No.: PCT/EP2010/005714

§ 371 (c)(1),
(2), (4) Date: Feb. 29, 2012

(87) PCT Pub. No.: WO2011/044984

PCT Pub. Date: Apr. 21, 2011

(65) Prior Publication Data

US 2012/0186459 A1 Jul. 26, 2012

(30) Foreign Application Priority Data

Oct. 15, 2009 (EP) ..... 09013018

(51) Int. Cl.

| | |
|---|---|
| ***F24C 3/10*** | (2006.01) |
| ***F24C 3/12*** | (2006.01) |
| ***F24C 7/08*** | (2006.01) |

(52) U.S. Cl.

CPC ..... *F24C 3/126* (2013.01); *F24C 3/122* (2013.01); *F24C 7/081* (2013.01); *F24C 7/083* (2013.01)

(58) Field of Classification Search

CPC ..... F24C 3/12; F24C 3/122; F24C 3/126; F24C 7/08; F24C 7/081; F24C 7/082; F24C 7/083

USPC ..... 99/331, 329 R, 333; 336/20 A; 126/39 G, 126/39 H, 39 R, 39 E; 236/20 A

See application file for complete search history.

(56) References Cited

U.S. PATENT DOCUMENTS

| | | | | |
|---|---|---|---|---|
| 3,100,995 | A * | 8/1963 | Woodward | 374/141 |
| 3,632,040 | A * | 1/1972 | de Gouville | 236/20 R |
| 6,663,009 | B1 * | 12/2003 | Bedetti et al. | 236/20 A |

FOREIGN PATENT DOCUMENTS

| | | |
|---|---|---|
| DE | 1454262 | 1/1969 |
| DE | 102005041574 | 4/2006 |
| EP | 0802374 | 10/1997 |
| EP | 1258683 | 11/2002 |

OTHER PUBLICATIONS

International Search Report for PCT/EP2010/005714, dated Nov. 2, 2010, 2 pages.

* cited by examiner

*Primary Examiner* — Reginald L Alexander
(74) *Attorney, Agent, or Firm* — Pearne & Gordon LLP

(57) ABSTRACT

A gas cooker including a cooktop with at least one burner having a burner crown, a support arranged to receive a cooking recipient above the burner, a sensor for detecting the temperature of the cooking recipient placed on the support, and a control unit for controlling the burner on the basis of sensor output values of the sensor, whereas the sensor is provided outside the burner crown a detachable connection, so that the sensor can be removed when cleaning the gas cooker.

20 Claims, 12 Drawing Sheets

Figure 1:
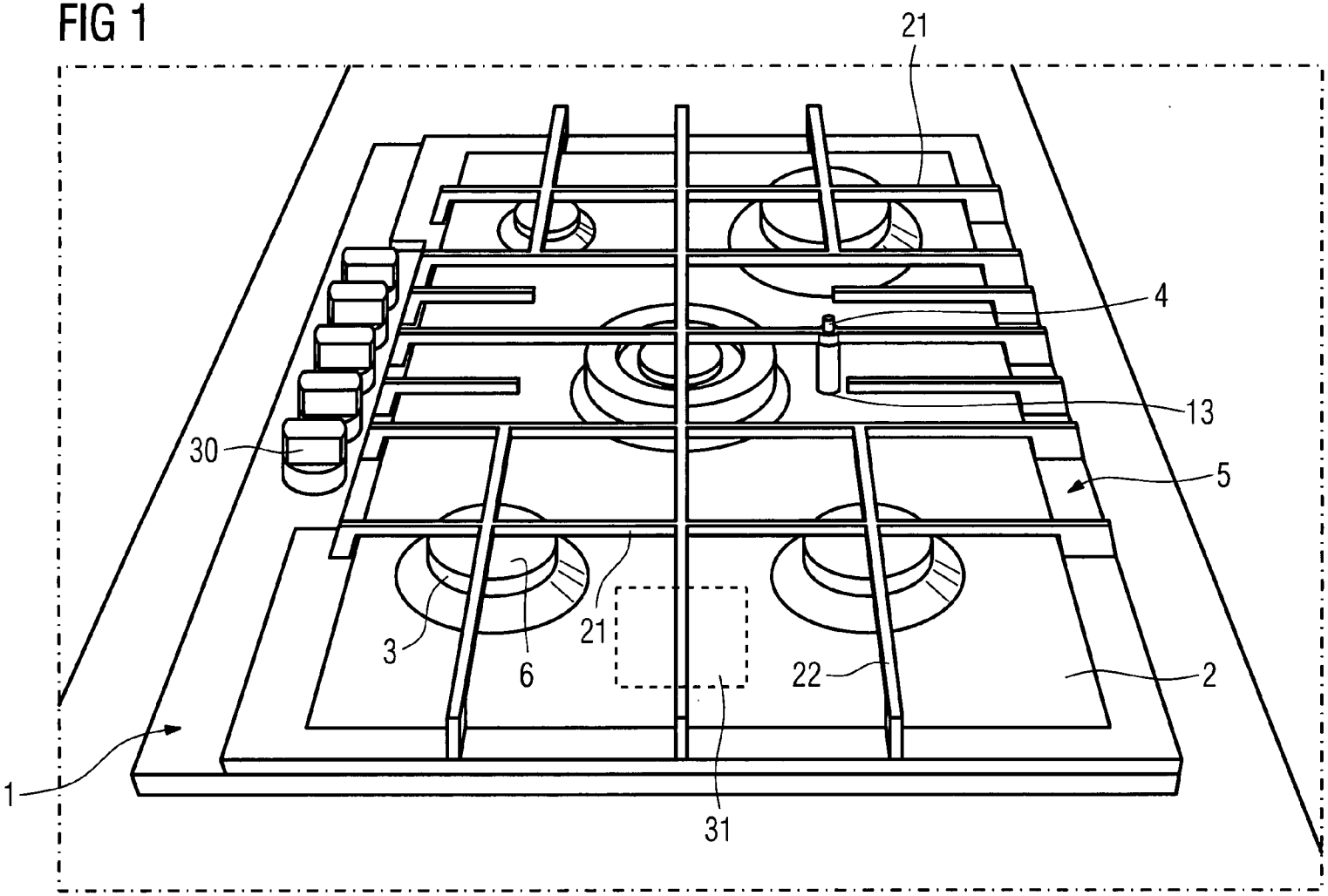

5
21'
40
4
13'
3

5'
40
13'
4
20
21'
3
2

GAS COOKER

TECHNICAL FIELD

The present invention relates to a gas cooker comprising a cooktop with at least one burner having a burner crown, a support arranged to receive a cooking recipient above the burner, a sensor for detecting the temperature of the cooking recipient placed on the support, and a control unit for controlling the burner on the basis of sensor output values of the sensor.

BACKGROUND TECHNOLOGY

Gas cookers of the above mentioned kind are for example known from DE 601 21 548 T2. The gas cooker described in this document comprises a cooktop with four individual gas burners. Each burner is provided with an individual support element, that can be placed on top of the cooktop for supporting a recipient. A temperature sensor is provided for each burner and extends vertically from the cooktop to be in close contact with the recipient. A gas valve is provided individually for each burner to control the gas flow. The temperature sensor and the gas valve are connected to a control unit, which operates the gas valve on the basis of output values of the temperature sensor. Accordingly, the burner is operated differently throughout different steps of a cooking process without changing the gas flow manually. E.g. the control unit can detect the cooking point of the food inside the recepient by detecting that the sensor output values of the temperature sensor indicate a not rising temperature during operation, so that the gas flow through the burner is reduced and the temperature is maintained to avoid overboiling.

Another embodiment shown in DE 601 21 548 T2 shows a cooktop with four individual burners. Each burner has a support which is formed by four support elements, which are arranged around the burner to receive a cooking recipient located above the respective burner. The support elements are formed integral with the cooktop as cylindrical convexities which are protruding to the upper side of the cooktop. One of the support elements is provided with a temperature sensor for detecting the temperature of the cooking recipient placed thereon. The temperature sensor is located at the upper side of the support element to be in close contact with the recipient. A gas valve is provided individually for each burner to control the gas flow. The temperature sensor and the gas valve are connected to a control unit for operating the gas valve on the basis of output values of the temperature sensor. The general function of the gas cooker according to this embodiment is the same as described above.

Another commonly used gas cooker is described in GB 969 096. It comprises a burner and a support, which is located above the burner for supporting the cooking recipient. The support comprises four legs, which are at their one end side connected to a central ring. On their other end side they are provided with a protruding foot so that an upper supporting surface of the support is provided in an elevated position with respect to the surface of a cooktop. One of the legs is provided with a vertical hole. A temperature sensor extends vertically from the cooktop through the hole to be in contact with a recipient placed on the support. The temperature sensor is connected to a thermostatic control, which operates a gas valve on the basis of sensor output values of the temperature sensor.

During the cooking process the cooktop normally becomes soiled, e.g. by splashes of oil or the like. The major drawback of gas cookers of the above mentioned kind is that their cooktops are difficult to clean. Elements protruding from the cooktop like the temperature sensor represent obstacles which slow down and complicate the cleaning process. At the edges between the cooktop and the protruding temperature sensor, dirt can easily be accumulated and is difficult to remove.

Starting from the above mentioned prior art technology it is an object of the present invention to provide a gas cooker having a cooktop which is easy to clean.

DISCLOSURE OF THE INVENTION

In order to solve this object the present invention provides a gas cooker of the above mentioned kind whose sensor is provided outside the burner crown by means of a detachable connection, so that the sensor can be removed when cleaning the gas cooker.

Accordingly, the gas cooker can easily be cleaned as a whole and no special care has to be paid to the sensor. Edges, which are usually formed at a mounting point of the sensor, disappear as soon as the sensor is removed, so that the area of the gas cooker around the mounting point as well as the sensor device itself can be cleaned easily and individually.

Preferably the detachable connection comprises a plug connection for electrically connecting the sensor. This allows to plug-in the entire sensor at this mounting point as well as an easy mounting and unmounting of the sensor without the use of tools.

Furthermore, the support can be arranged in a manually removable manner. This allows an easy cleaning of the cooktop and the support, since edges, which are formed between the cooktop and the support and which tend to accumulate dirt, are removed as soon as the support is separated from the cooktop.

According to one embodiment of the present invention, the sensor is arranged at the support. Accordingly, the sensor can be removed together with the support and does not have to be handled separately. The electric connection to the control unit can be realized by a direct connection between the sensor to the cooktop or by a connection between the support and the cooktop.

Moreover, the sensor can be detachably arranged at the support. This allows a separate cleaning of the sensor and the support.

Since the support is usually difficult to clean because the dirt is burned in and encrusted, an intense cleaning of the support can be carried out without the danger of damaging the sensor when being separated. The connection to the control unit is realized via the support.

Alternatively the sensor can be arranged at the cooktop apart from the support. The position of the sensor can be freely choosen on the cooktop to be most suitable for commonly used recipients.

Preferably the sensor is arranged in such a manner that it is in contact with the bottom of a recipient placed on the support. This arrangement allows the use of different kinds of sensors, e.g. a temperature sensor or vibration sensors, which detect the boiling point of liquid heated in the recipient by the particular vibration of bubbles formed therein. In both cases the direct contact between the sensor and the recipient allows to obtain accurate output values from the sensor. A measurement at the bottom of the recipient is most suitable, because the bottom is directly heated by the burner and therefore represents the hottest part of the recipient.

The sensor and the control unit can be provided with a wireless connection for the transmission of the sensor output values from the sensor to the control unit. This allows a simple construction of the gas cooker, since no cables are required. Cables are difficult to install and to handle, provide additional costs and are frequently the origin of defects due to damage. Moreover, a wireless connection makes plugs superfluous, which are also a frequent cause of malfunction.

Additionally, a shielding element can be provided for shielding the sensor. Especially when located in proximity to the burner, the sensor is exposed to heat irradiation and convection originated by the burner. The shielding element can be provided to merely shield the sensor in the direction towards the burner or to surround the sensor entirely.

According to a preferred embodiment the shielding element can be arranged on top of the cooktop by means of a detachable connection. This allows an individual placement of the shielding element separate from the sensor to reduce heat transmission towards the sensor. Moreover, removing the shielding element also allows an easy cleaning of the cooktop.

Preferably the shielding element and the cooktop comprise magnetic holding means. The holding means comprise a magnet and a ferromagnetic material, one of them being provided at the shielding element and the other at the cooktop. Accordingly, the sensor can easily be mounted or unmounted without the need for the use of tools. At the cooktop, the holding means can be provided integral with the cooktop or below its surface, so that a homogeneous surface structure can be maintained.

Furthermore, the shielding element can be integrated with the support. Accordingly, the shielding element is automatically arranged along with the support. This construction is applicable to sensors, which are provided at the cooktop, as well as to sensors, which are attached to the support.

Preferably the shielding element is arranged at the support by means of a detachable connection. This facilitates the cleaning of the support and the shielding element. Additionally the shielding element can be easily substituted if required.

Alternatively the shielding element can be formed integral with the support. This allows a simple construction of the combined support and the shielding element and facilitates the handling.

Preferably the shielding element is made of metal. Metal is suitable for the use in gas cookers, since it withstands the influence of high temperatures which arise due to the flames generated by the gas burner. It also offers a high grade of reflection of thermal radiation. If a magnetic connection is provided in order to connect the shielding element to the cooktop, the use of a ferromagnetic metal allows a simple and integral construction of the shielding element, so that only the corresponding magnet has to be provided at the cooktop.

Furthermore multiple sets of burners and sensors can be provided and connected to one control unit for controlling each burner individually. This simplifies the structure of the gas cooker, since different recipients can be heated with an individual burner control provided by one control unit.

Finally, multiple sets of burners and sensors are commonly arranged with a single support to receive a cooking recipient above each burner. Accordingly, the support can extend over the entire cooktop, so that it can be reliably placed on top of the cooktop. Nevertheless, the support can comprise a sensor and/or a shielding element for each individual burner, which is located in the vicinity thereof when being placed on top of the cooktop.

BRIEF DESCRIPTION OF THE ACCOMPANYING DRAWINGS

The detailed configuration, features and advantages of the present invention will become apparent in the course of the following description with reference to the accompanying drawings.

Figure 2:
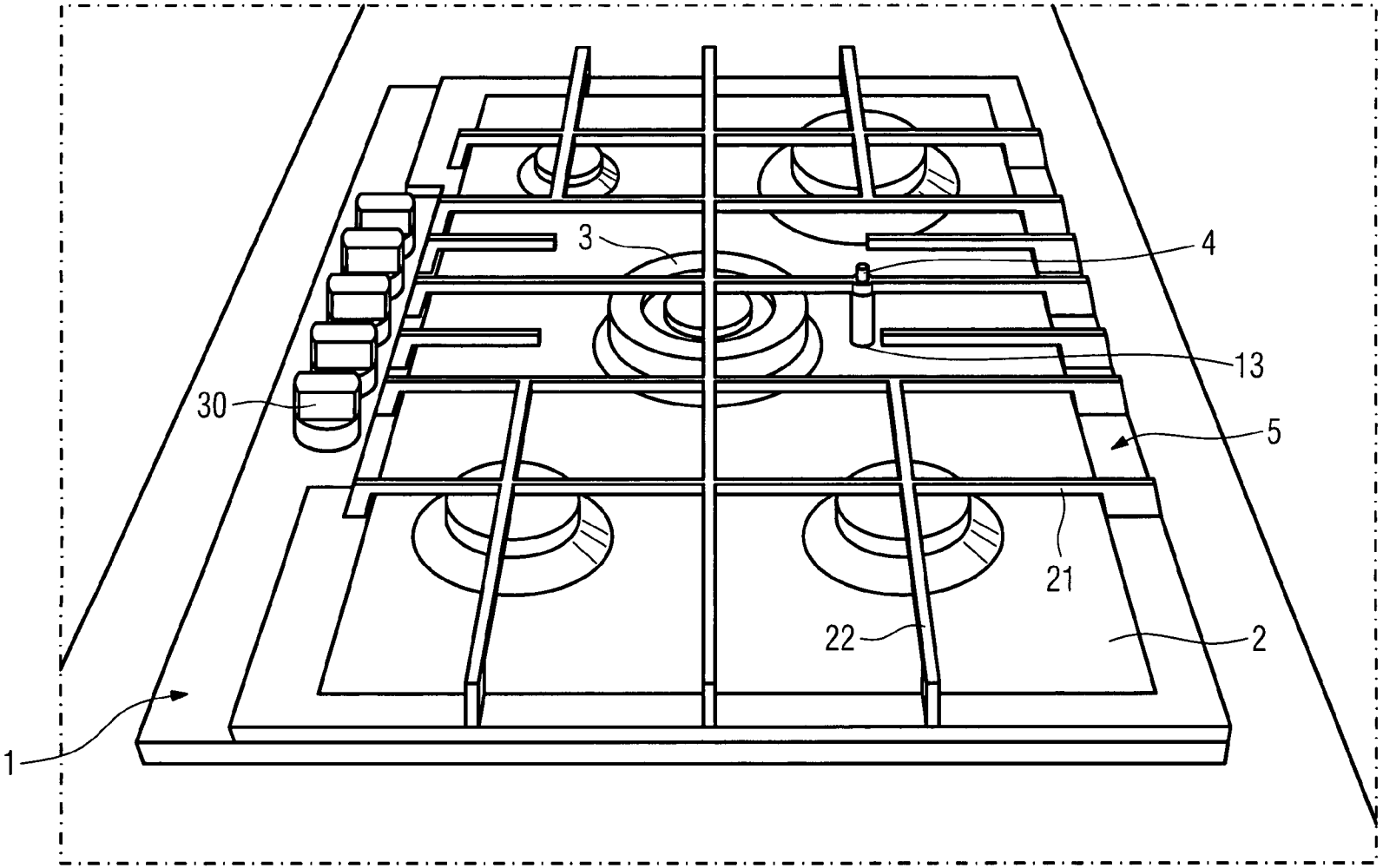
Figure 3:
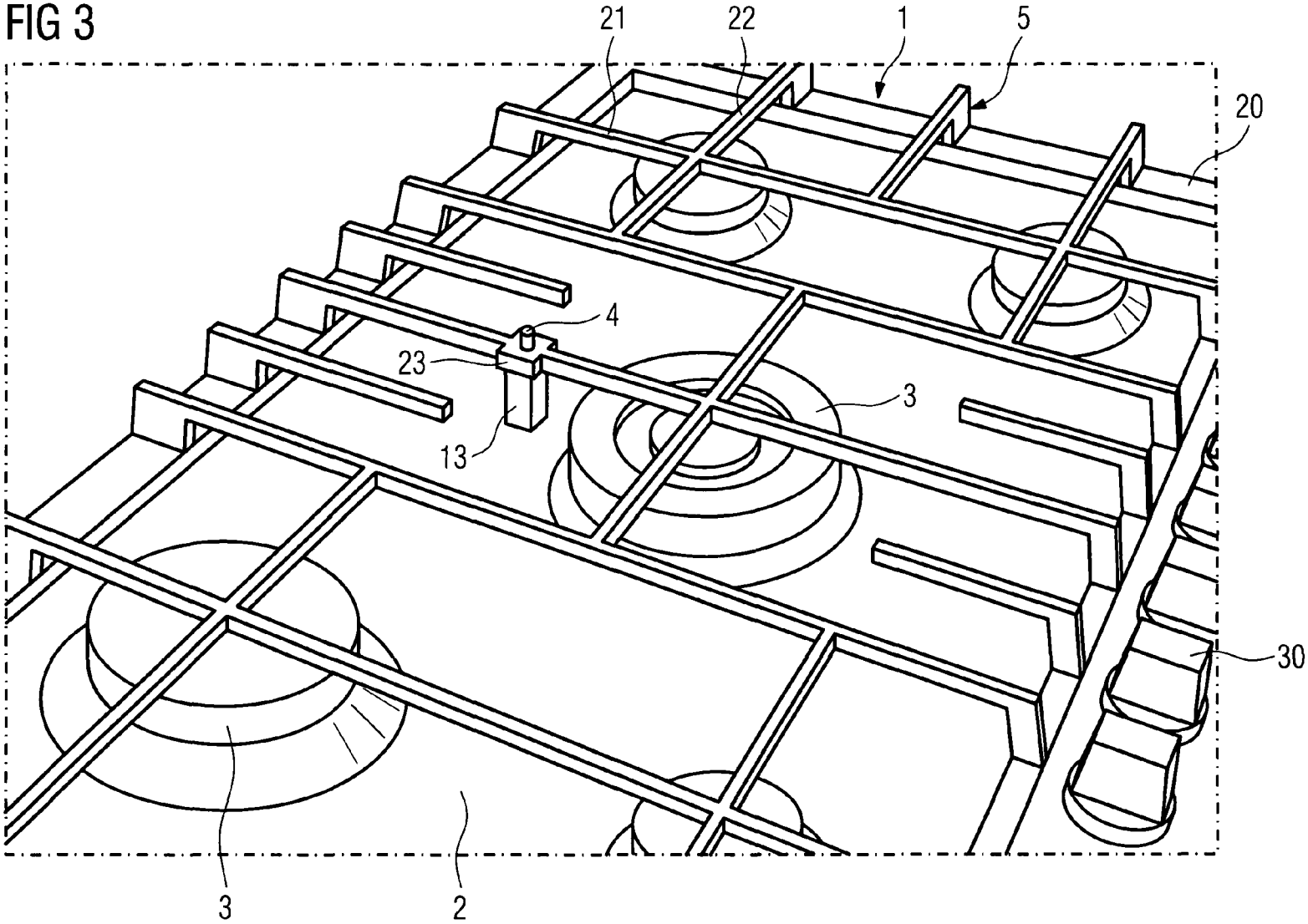
Figure 4:
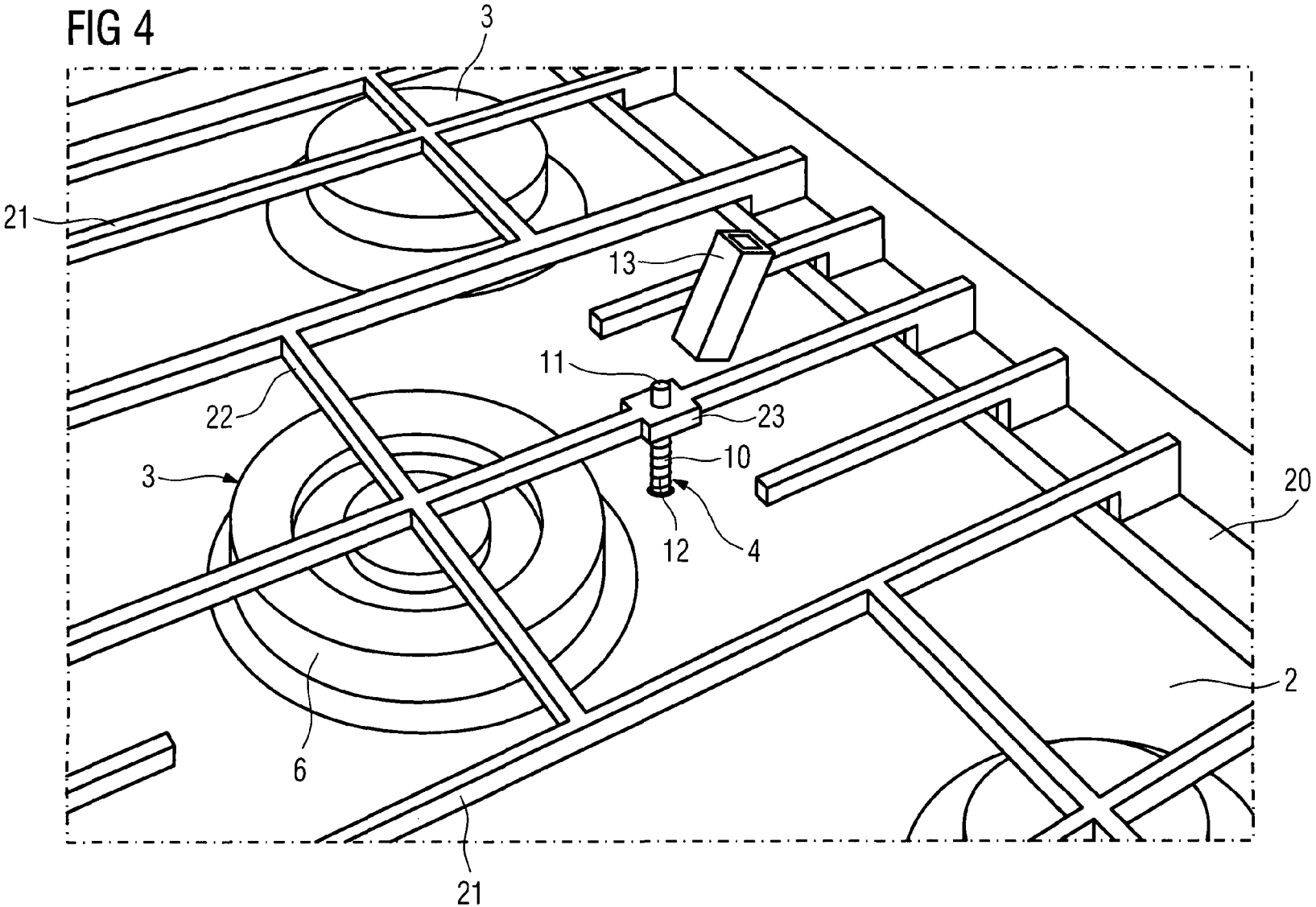
Figure 5:
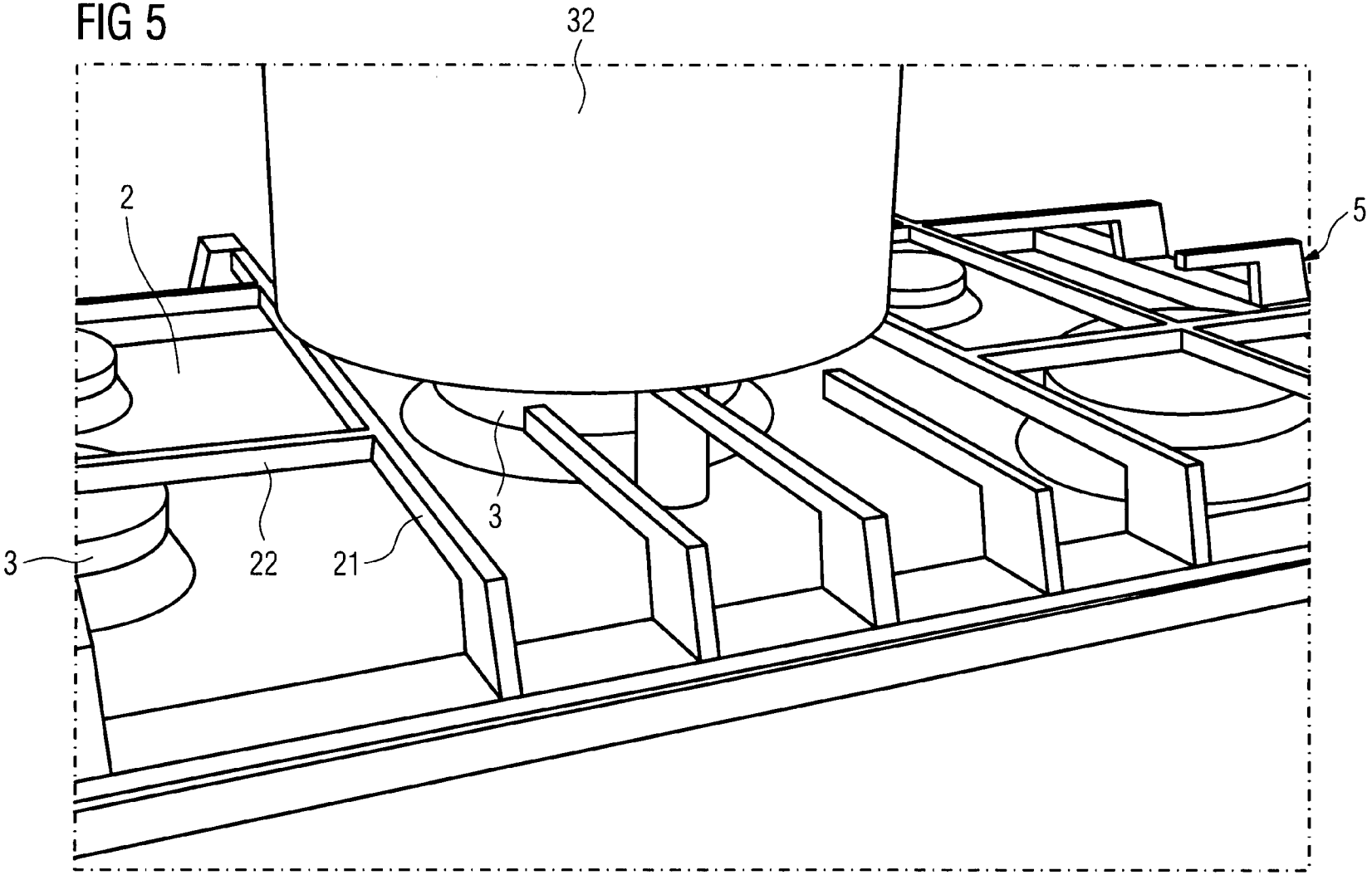
Figure 6:
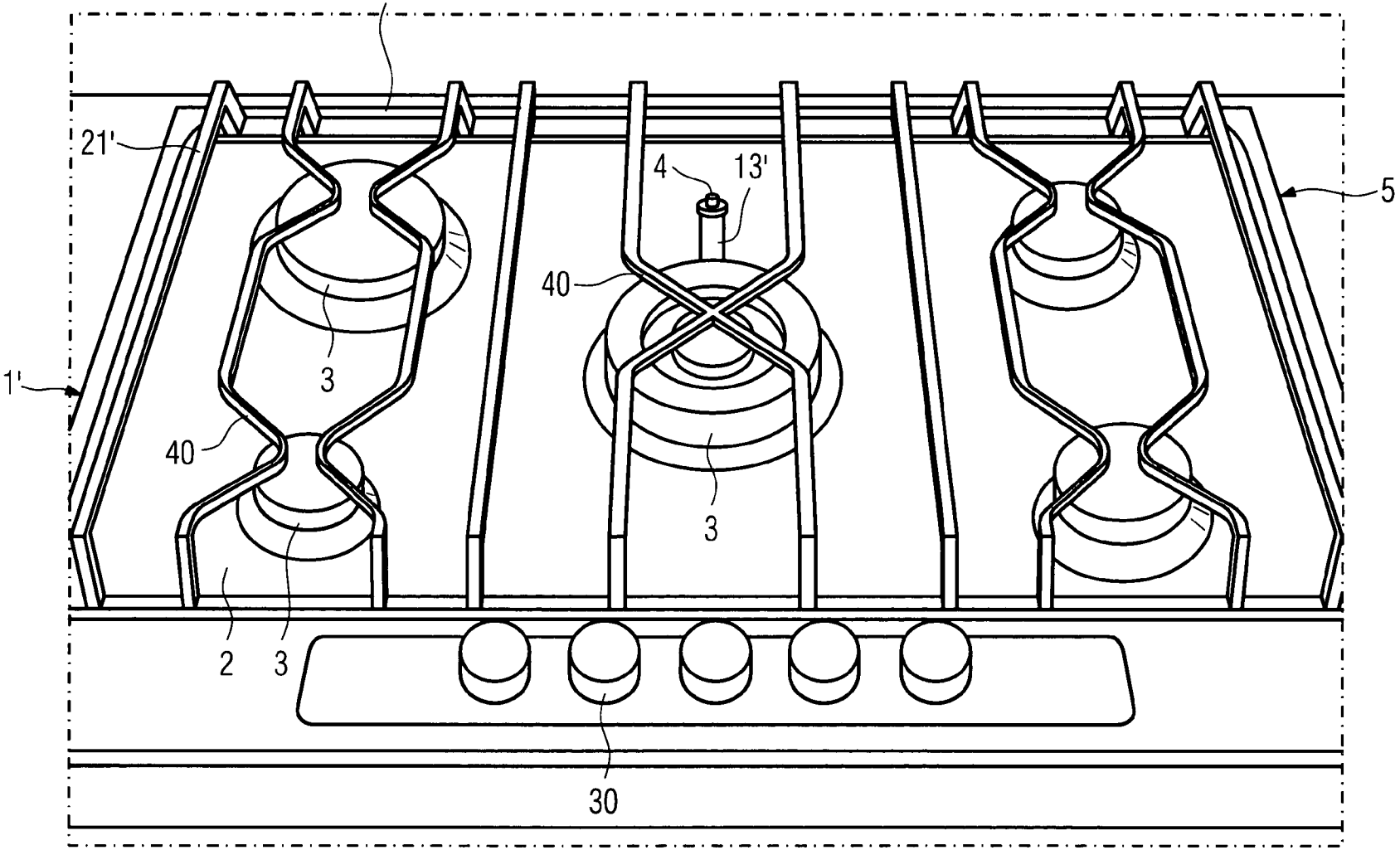
Figures 7, 8:
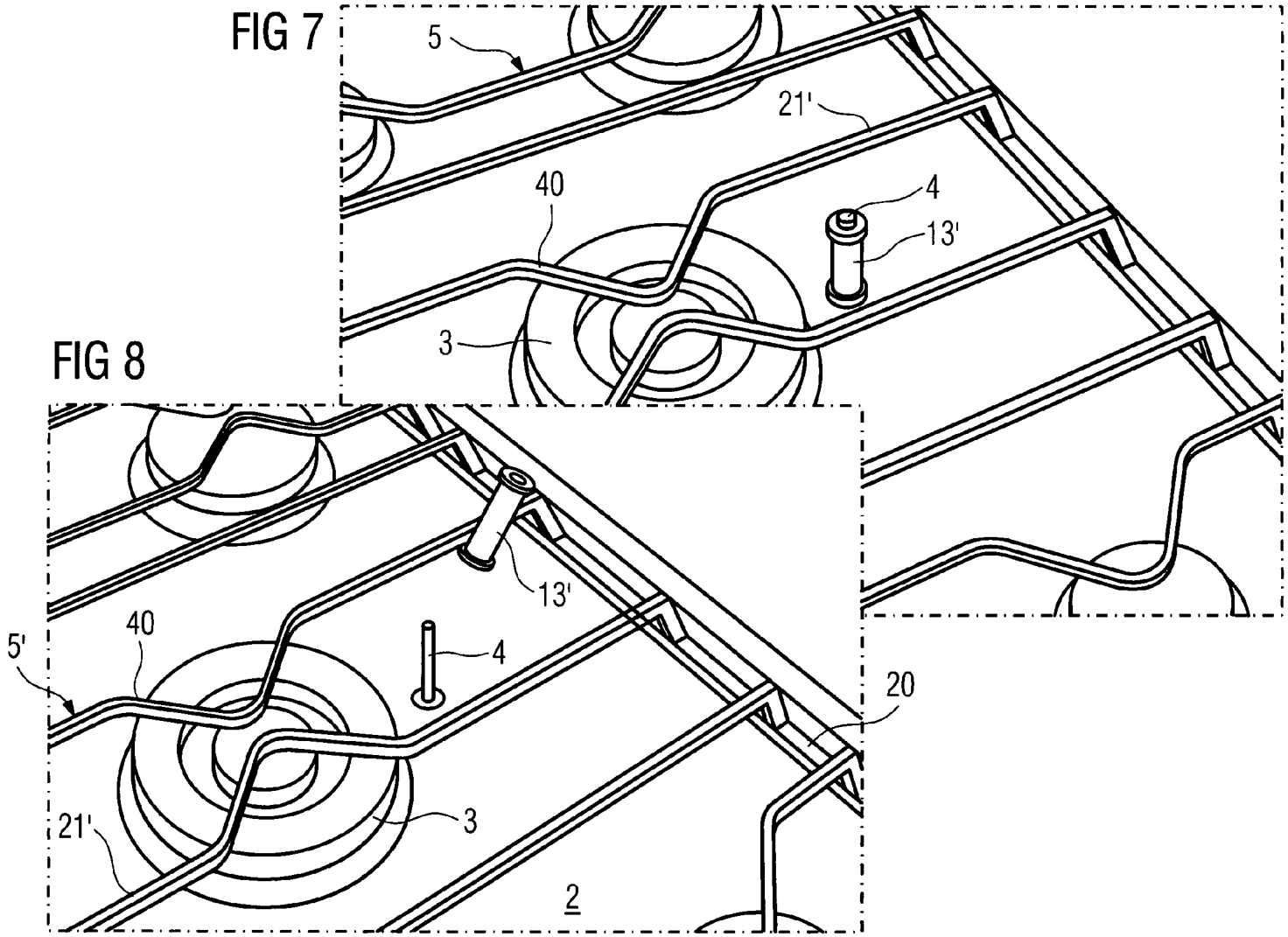
Figure 9:
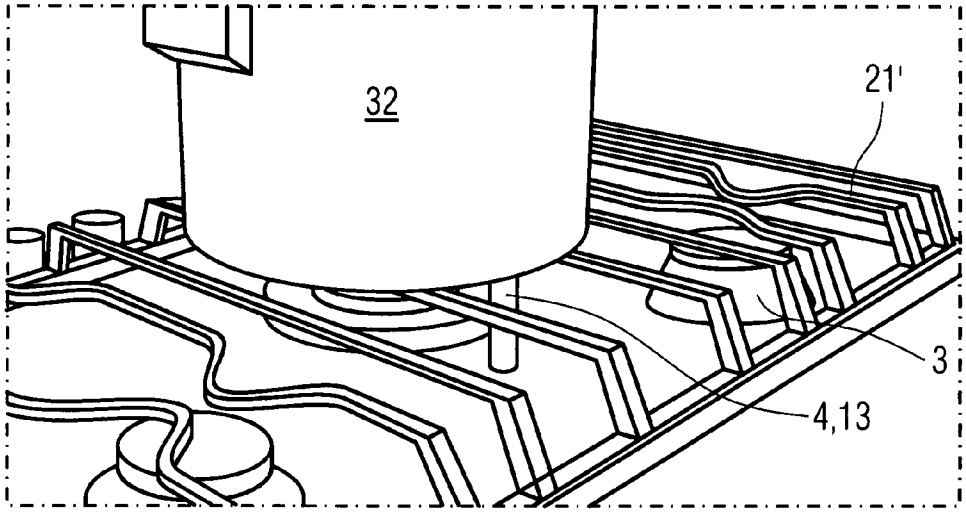
Figure 10:
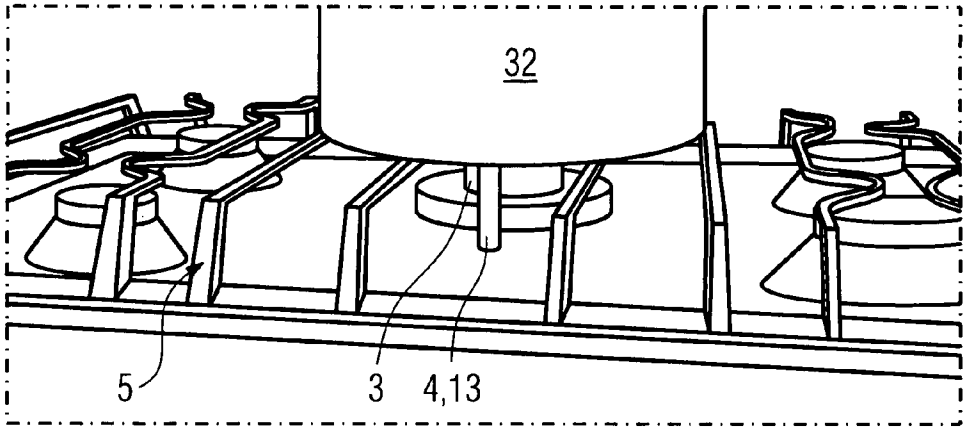
Figure 11:
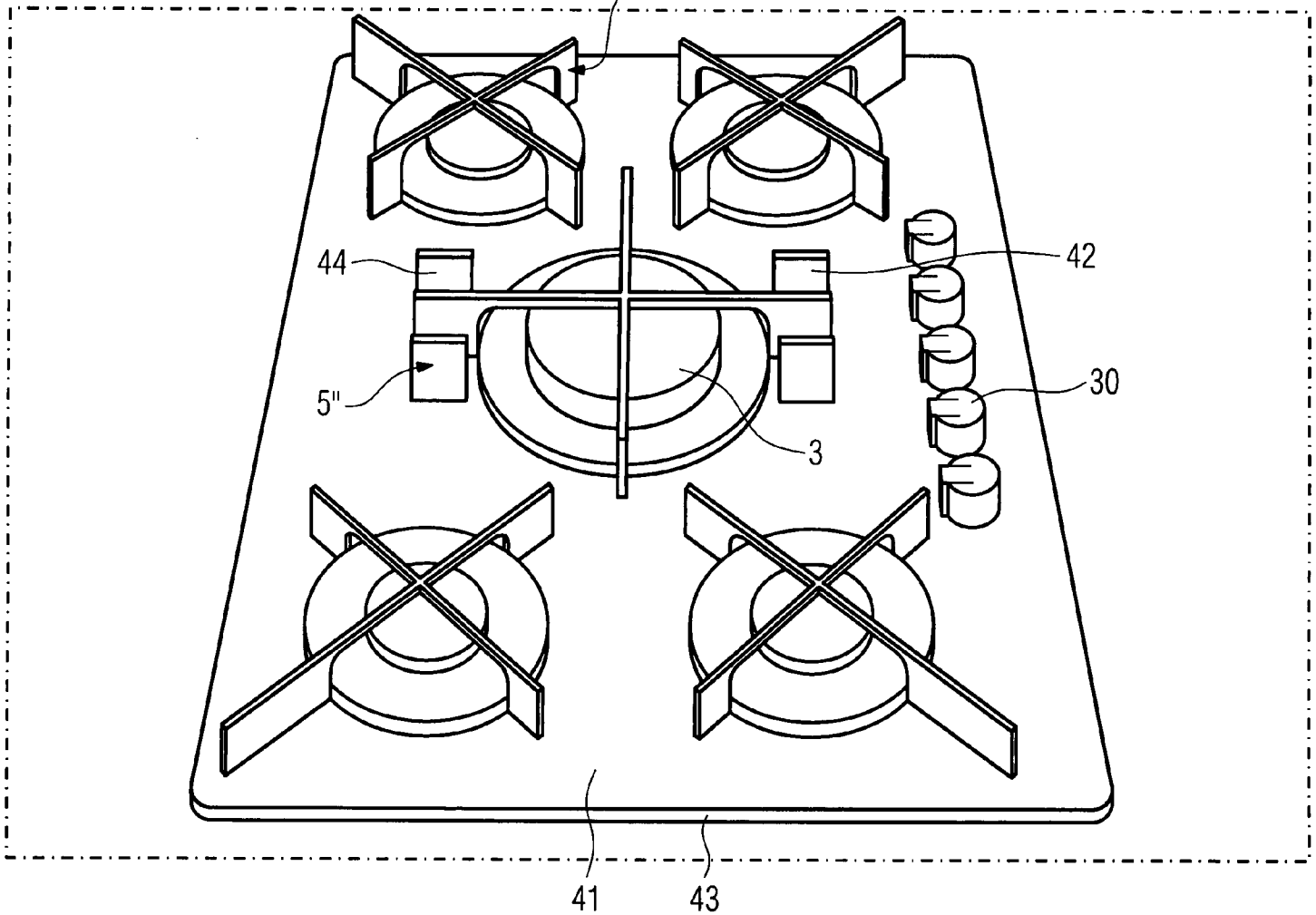
Figure 12:
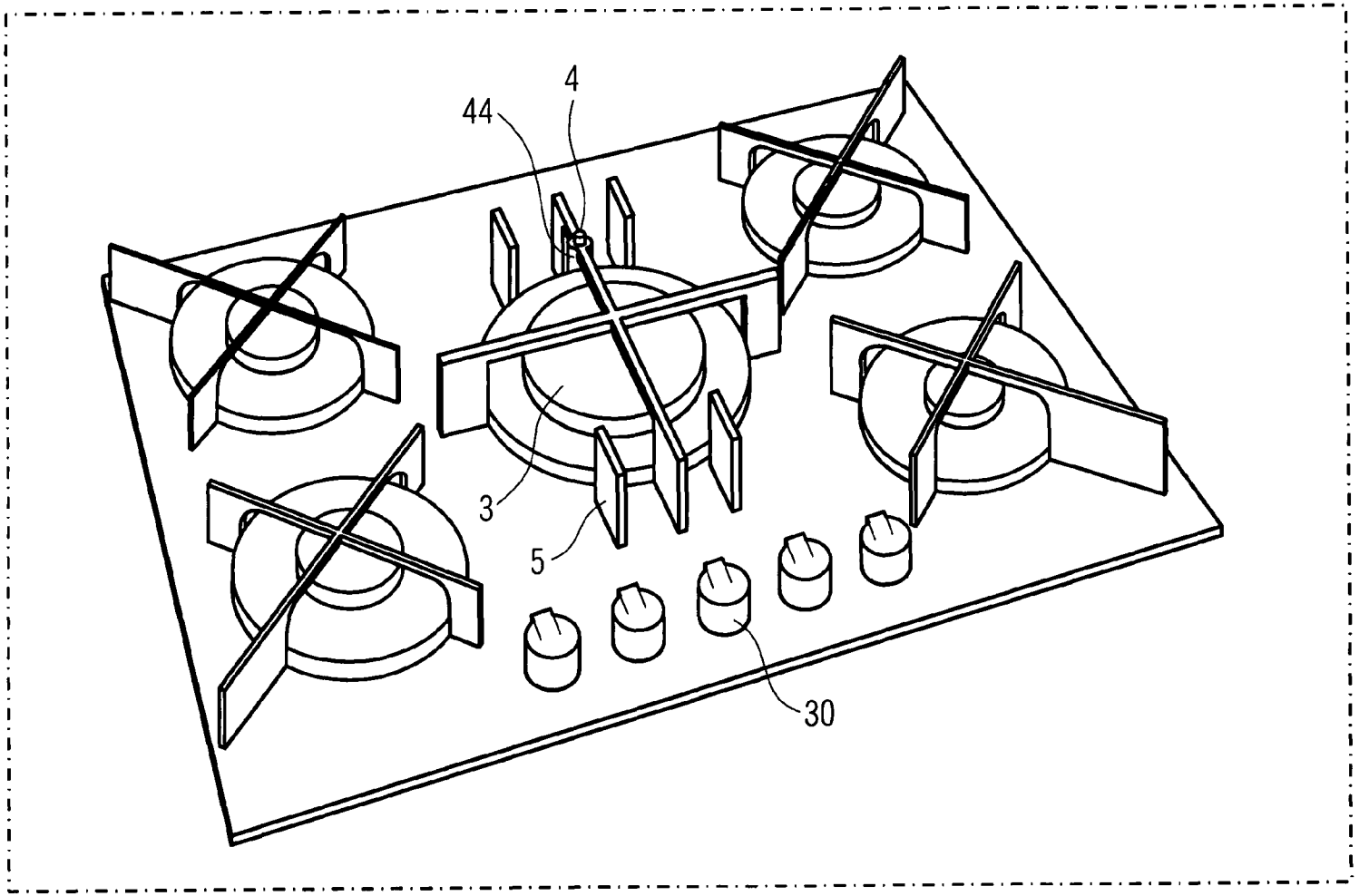
Figure 13:
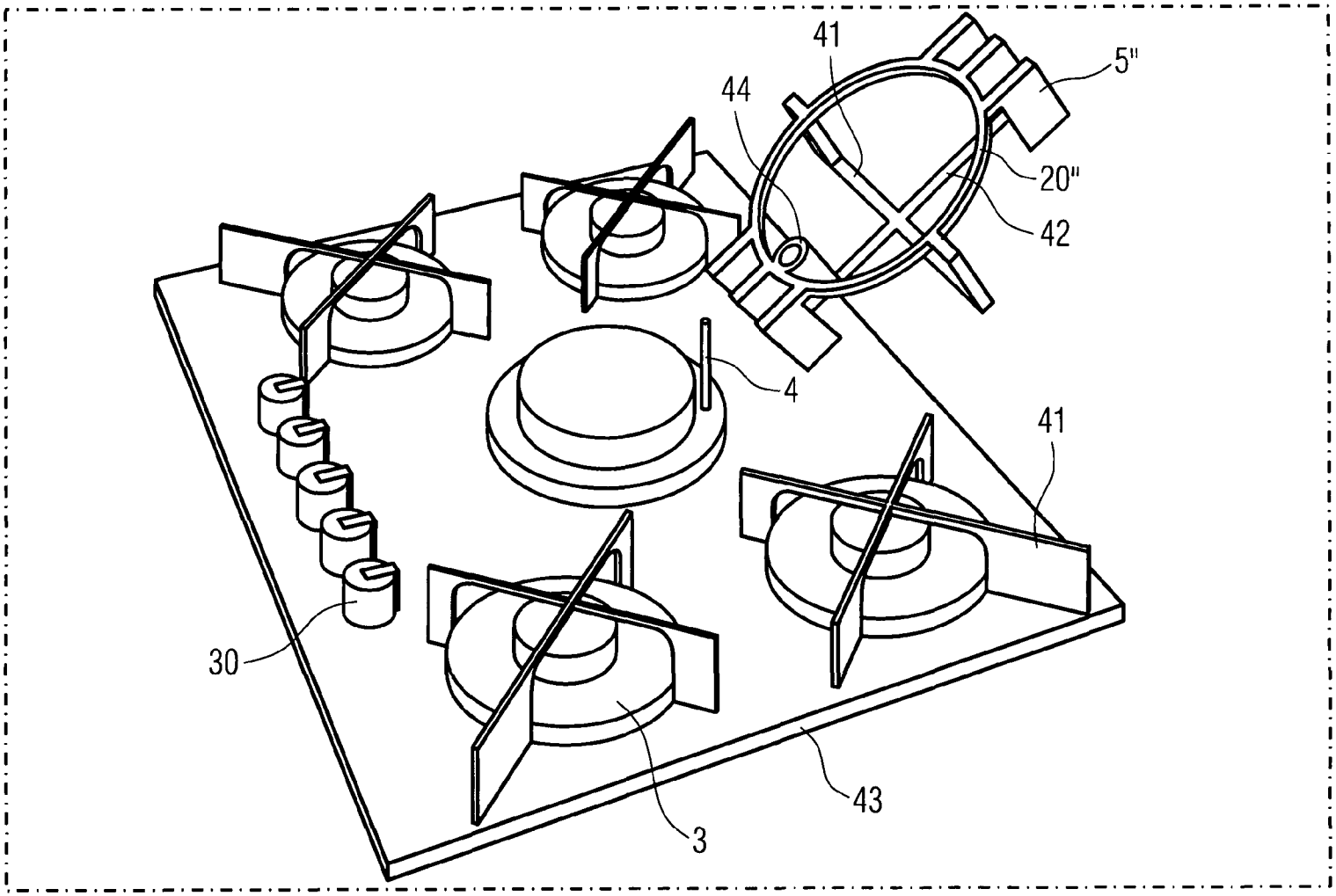
Figure 14:
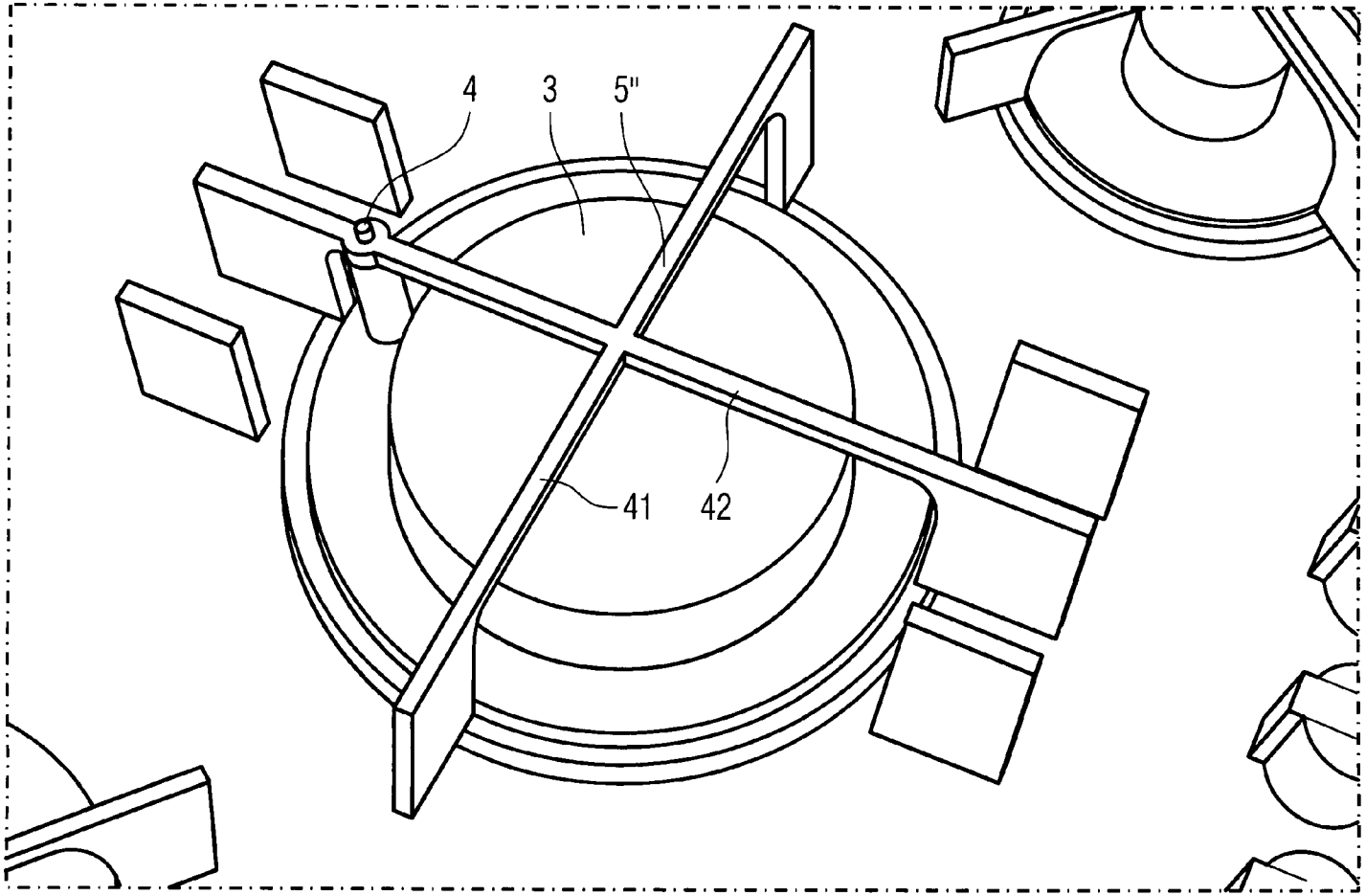

FIG. 1 is a perspective view of a gas cooker according to a first embodiment of the present invention, FIG. 2 is a closer perspective view of the gas cooker of FIG. 1, FIG. 3 is a rotated perspective view of the gas cooker of FIG. 1 showing a central part thereof, FIG. 4 is a perspective view of a central burner of the gas cooker of FIG. 1 with a temperature sensor and a removed shielding element, FIG. 5 is a perspective view showing the central burner of the gas cooker of FIG. 1 with a cooking recipient placed thereon, FIG. 6 is a perspective view of a gas cooker according to a second embodiment of the present invention, FIG. 7 is a perspective view of the gas cooker of FIG. 6 showing the central burner thereof, FIG. 8 is a perspective view of a central part of the gas cooker of FIG. 6 with a temperature sensor and a shielding device removed from the sensor, FIG. 9 is a perspective view of the central burner of the gas cooker of FIG. 6 with a cooking recipient placed thereon, FIG. 10 is a rotated perspective view of the burner with the recipient of FIG. 9, FIG. 11 is a perspective view of a gas cooker according to a third embodiment of the present invention, FIG. 12 is a rotated perspective view of the gas cooker of FIG. 11, FIG. 13 is a rotated perspective view of the gas cooker of FIG. 11 with the support of the central burner being removed from the cooktop, and FIG. 14 is a perspective view the gas cooker of FIG. 11 showing the central burner thereof.

DETAILED DESCRIPTION OF THE PREFERRED EMBODIMENTS

FIGS. 1 to 5 show a gas cooker 1 according to a first embodiment of the present invention. The gas cooker 1 comprises a cooktop 2 with five individual burners 3, a temperature sensor 4 and a support 5, which is positioned on top of the cooktop 2.

The burners 3 are arranged at the cooktop 2 in the form of a rectangle, whereas one burner 3 is located in each corner thereof and one in its center. Each burner 3 comprises a burner crown 6 with circumferential gas outlets and ignition means for lightening the gas.

The temperature sensor 4 is provided at the cooktop 2. The temperature sensor 4 comprises a cylindrical base body 10, a sensor head 11 and a spring 12, which is arranged around the base body 10 and resilently pushes the sensor head 11 upwards. The temperature sensor 4 is plugged with its base body 10 onto the cooktop 2. The plug connection also comprises electrical connectors for connecting the temperature sensor 4 to the cooktop 2.

A shielding element 13 is provided in the form of a hollow square cylinder. The shielding element 13 is positioned in an upright position on top of the cooktop 2 so that it surrounds the temperature sensor 4. The shielding element 13 is made of metal to protect the temperature sensor 4 from heat irradiation and heat convection.

The support 5 comprises an exterior frame 20, which is in contact with the cooktop 2 when the support 5 is placed thereon. The support 5 further comprises support struts 21, which extend between the longitudinal sides of the frame 20, as well as cross struts 22 perpendicular to the support struts 21. The cross struts 22 extend partially between end sides of the frame 20 and the support struts 21, and partially only between the support struts 21. The struts 21, 22 are provided to form a support plane elevated with respect to the frame 20 and arranged to form a cross through the center of each burner 3 when the support 5 is placed on top of the cooktop 2.

The central support strut 21 is formed with a square recess 23, which is positioned close to the central burner 3. When the support 5 is placed on top of the cooktop 2, the temperature sensor 4 and the shielding element 13 are inserted into the recess 23.

The gas cooker 1 further comprises five control knobs 30, which are arranged laterally on the cooktop 2. Each control knob 30 is associated to one burner 3 for adjusting the burner power.

The temperature sensor 4, the control knob 30 for controlling the central burner 3 and a not visible gas valve are connected to a control unit 31, which is schematically shown by the dashed lines in FIG. 1 and positioned below the cooktop 2. The control unit 31 controls the burner 3 on the basis of sensor output values of the temperature sensor 4 and the desired burner power adjusted by means of the knob 30.

Accordingly, when e.g. a medium burner power is set by the control knob 30, the control unit 31 first fully opens the valve, so that the burner 3 is operated at its maximum power. When the control unit 31 detects that the bottom of the recipient 32 reaches the temperature assigned to the medium burner power, the control unit 31 partially closes the valve so that the temperature is maintained. Accordingly, the cooking process is shortened and at the same time performed with a high security, because a user does not have to operate the control knob 30 for adopting the power setting manually after the desired temperature is reached.

The control unit 31 can also be adopted to detect the presence or absence of the recipient 32 when the burner 3 is operated. If no recipient 32 is present, the temperature sensor 4 will essentially provide identical sensor output values, which is detected by the control unit 31, so that the burner 3 can be switched off by closing the valve. Furthermore, the control unit 31 can prevent the recipient 32 from being excessively heated, e.g. to a temperature when oil is so much heated that it vaporises. When the temperature sensor 4 transmits a sensor output value indicating such an excessive temperature, the control unit 31 automatically closes the gas valve at least partially to switch off or to reduce the burner power until the temperature in the recipient 32 has fallen.

FIGS. 6 to 10 show a second embodiment of a gas cooker 1' according to the present invention. Components, which are identical to those of the first embodiment, are provided with the same reference numbers.

The gas cooker 1' is provided with a cooktop 2 that has five burners 3 located thereon. A temperature sensor 4 is provided on top of the cooktop 2 and structured like in the first embodiment. A shielding element 13' is provided as a hollow circular cylinder made of ferromagnetic steel to be placed around the temperature sensor 4. For connecting the shielding element 13' to the cooktop 2, a magnet is provided below the cooktop 2, which holds the shielding element 13' by means of a magnetic force between the magnet and the shielding element 13'.

The gas cooker 1' comprises a modified support 5', which is provided with a frame 20 for placing it on the cooktop 2. The support 5' only comprises support struts 21', which extend between longitudinal sides of the frame 20. In order to provide a reliable support for cooking recipients 32, the support struts 21' are formed in the area of each burner 3 with a V-type bulge 40 and are arranged so that the bottom of the bulges 40 of two adjacent struts 21' essentially meet in the center of each burner 3.

The control knobs 30, the control unit 31 and the valve of the central burner 3 correspond to the ones of the first embodiment and are also operated in the same way, when a recipient 32 is placed on top of central burner 3 for heating.

FIGS. 11 to 14 show a third embodiment of the gas cooker according to the present invention. Components, which are identical to those of the first embodiment, are provided with the same reference numbers.

The Gas cooker 1" comprises a cooktop 2 with five individual burners 3, which are arranged as described with respect to the first embodiment. A temperature sensor 4, which corresponds to the one of the first embodiment, is provided on the cooktop 2 in vicinity of central burner 3.

An individual support 5" is provided for each burner 3. Each support 5" comprises two horizontal bars 41, 42, which are arranged to form a cross and to provide a horizontal support plane for supporting a recipient 32 thereon. The bars 41 are provided at their end regions with feet 43, whose lower ends are connected to a circular frame 20" resting on top of the cooktop 2.

The bar 42 of the support 5" of the central burner 3 is provided with a through boring 44 for receiving the temperature sensor 4 when the support 5" is placed on top of the cooktop 2. Accordingly, the support 5" comprises an integral shielding element 44 that surrounds the temperature sensor 4 when the support 5" is placed on top of the cooktop 2.

The operation of the gas cooker 1" corresponds to the operation of the gas cooker 1 of the first embodiment, so that a repeated description is omitted.

LIST OF REFERENCE NUMERALS

1, 1', 1" gas cooker
2 cook top
3 burner
4 temperature sensor
5, 5', 5" support
6 burner crown
10 base body
11 sensor head
12 spring
13, 13' shielding element
20, 20" exterior frame
21, 21' support strut
22 cross strut
23 recess
30 control knob
31 control unit
32 recipient
40 bulge
41, 42 horizontal bar
43 foot
44 through boring

The invention claimed is:

1. A gas cooker comprising a cooktop with at least one burner having a burner crown, a support arranged to receive a cooking recipient above the at least one burner, a sensor for detecting a temperature of the cooking recipient placed on the support, and a control unit for controlling the burner based on sensor output values of the sensor, wherein the sensor is provided outside the burner crown by means of a detachable sensor connection, so that the sensor can be removed from the cooktop when cleaning the gas cooker wherein the gas cooker further comprises a shielding element for shielding the sensor, and wherein the shielding element is arranged on top of the cooktop by means of a detachable shielding element connection.

2. The gas cooker according to claim 1, wherein the detachable sensor connection comprises a plug connection for electrically connecting the sensor to the cooktop.

3. The gas cooker according to claim 1, wherein the support is arranged on the cooktop in a manually removable manner.

4. The gas cooker according to claim 1, wherein the sensor is arranged at the support.

5. The gas cooker according to claim 1, wherein the sensor is arranged at the cooktop.

6. The gas cooker according to claim 1, wherein the sensor is arranged to be in contact with a bottom of the cooking recipient placed on the support.

7. The gas cooker according to claim 1, wherein the sensor and the control unit comprise a wireless connection for transmitting the sensor output values from the sensor to the control unit.

8. The gas cooker according to claim 1, wherein the shielding element and the cooktop comprise magnetic holding means.

9. The gas cooker according to claim 1, wherein the shielding element is made of metal.

10. The gas cooker according to claim 1, further comprising a plurality of burners and sensors connected to the control unit for controlling each of said plurality of burners individually.

11. The gas cooker according to claim 10, wherein the plurality of burners and sensors are commonly arranged with a single support to receive a cooking recipient above each of said plurality of burners.

12. The gas cooker according to claim 1, wherein a position of the sensor on the cooktop can be freely chosen.

13. The gas cooker according to claim 4, wherein the support comprises a recess in which the sensor is inserted.

14. The gas cooker according to claim 4, wherein the support comprises a through-bore formed in a bar of the support, wherein the sensor extends through the through-bore when the support is placed on the cooktop.

15. A gas cooker comprising a cooktop with at least one burner having a burner crown, a support arranged to receive a cooking recipient above the at least one burner, a sensor for detecting a temperature of the cooking recipient placed on the support, and a control unit for controlling the burner based on sensor output values of the sensor, wherein the sensor is provided outside the burner crown by means of a detachable sensor connection, so that the sensor can be removed from the cooktop when cleaning the gas cooker, wherein the gas cooker further comprises a shielding element for shielding the sensor, and wherein the shielding element is integrated with the support.

16. The gas cooker according to claim 15, wherein the shielding element is arranged at the support by means of a detachable shielding element connection.

17. The gas cooker according to claim 15, wherein the shielding element is formed integral with the support.

18. The gas cooker according to claim 15, wherein the sensor is arranged to be in contact with a bottom of the cooking recipient placed on the support.

19. The gas cooker according to claim 15, wherein the sensor and the control unit comprise a wireless connection for transmitting the sensor output values from the sensor to the control unit.

20. The gas cooker according to claim 15, wherein the support is arranged on the cooktop in a manually removable manner.

* * * * *